US005230757A

United States Patent [19]

Rundman et al.

[11] Patent Number: 5,230,757

[45] Date of Patent: Jul. 27, 1993

[54] AS-CAST, AGE-HARDENED CU-SN-NI WORM GEARING AND METHOD OF MAKING SAME

[75] Inventors: Karl B. Rundman, Atlantic Mine; Mark D. Gugel, Hancock; David A. Nichols, Acme, all of Mich.

[73] Assignee: Cone Drive Operations, Inc., Traverse City, Mich.

[21] Appl. No.: 785,042

[22] Filed: Oct. 30, 1991

Related U.S. Application Data

[62] Division of Ser. No. 664,346, Mar. 4, 1991, Pat. No. 5,100,487.

[51] Int. Cl.[5] ..... C22F 1/08

[52] U.S. Cl. ..... 148/539; 148/553

[58] Field of Search ..... 148/3, 12.7 C, 160, 148/539, 553

[56] References Cited

U.S. PATENT DOCUMENTS

| | | | |
|---|---|---|---|
| Re. 30,854 | 1/1982 | Plewes et al. | 420/473 |
| 1,457,288 | 5/1923 | Ostendorf | 420/473 |
| 1,535,542 | 4/1925 | Price | 420/473 |
| 1,816,509 | 7/1931 | Wise | 148/12.7 R |
| 1,928,747 | 10/1933 | Wise | 148/412 |
| 2,117,106 | 5/1939 | Silliman | 148/160 |
| 3,156,589 | 11/1969 | Klement | 148/3 |
| 4,406,712 | 9/1983 | Louzon | 148/160 |
| 4,555,272 | 11/1985 | Ashok et al. | 148/3 |

FOREIGN PATENT DOCUMENTS

| | | | |
|---|---|---|---|
| 55-2722 | 1/1980 | Japan | 148/12.7 C |

OTHER PUBLICATIONS

Scorey, C. R., Chin, D., White, M. J., and Livak, R. J., "Spinodal Cu-Sn-Ni Alloys for Electronic Applications" *Metal Powder Report*, Jun. 1985, pp. 347-350.

Schwartz, L. H., Mahajan, S., and Plewes, J. T., "Spinodal Decomposition in a Cu-9 wt %Ni-6 wt %Sn Alloy", *ACTA Metallurgica* May 22, 1974, pp. 601-609.

Schwartz, L. H. and Plewes, J. T., "Spinodal Decomposition in a Cu-9 wt %-6 wt %Sn II: A Critical Examination of Mechanical Strength of Spinodal Alloys", *ACTA Metallurgica*, Jul. 22, 1974, pp. 911-921.

Tsubakino, Harushige, "Discontinuous Preception in a Cu-Sn Alloy" Metallography, vol. 17, (New York: Elsevier Science Publishing Co. (1984) pp. 371-382.

Louzon, T. J., "Tensile Property Improvements of Spinodal Cu-15Ni-8Sn by Two Phase Heat Treatment", Transactions of the ASME, vol. 104, Jul. 1982, pp. 234-240.

"Nicuite", *Alloy Digest*, Apr. 1958.

*Primary Examiner*—George Wyszomierski

*Attorney, Agent, or Firm*—Flynn, Thiel, Boutell & Tanis

[57] ABSTRACT

Worm gearing having improved wear and strength properties comprises a Cu, 8.0-13.0 w/o Sn, 3.5-5.0 w/o Ni alloy aged in the as-cast condition to strengthen the dendritic microstructural constituent (e.g., alpha phase) while retaining the as-cast, relatively hard interdendritic constituents. The overall Ni concentration of the alloy does not exceed about 5 w/o and the Ni concentration across individual as-cast dendrites is decreased at the dendrite edges (grain boundaries) to hinder formation of a discontinuous, embrittling grain boundary product that is deleterious to these properties.

7 Claims, 10 Drawing Sheets

MILLION FATIGUE CYCLES

MILLION FATIGUE CYCLES

MILLION FATIGUE CYCLES

AS-CAST, AGE-HARDENED CU-SN-NI WORM GEARING AND METHOD OF MAKING SAME

This is a division of application Ser. No. 664,346, filed on Mar. 4, 1991, now U.S. Pat. No. 5,100,487.

FIELD OF THE INVENTION

The present invention relates to as-cast, age-hardened Cu-Sn-Ni worm gearing and a method for making same.

BACKGROUND OF THE INVENTION

Cu-Sn alloys (bronzes) have been used in gearing and as a bearing material for many years. Gear applications use this material in the cast condition characterized by a relatively fine scale dendritic structure produced by chill casting centrifugally. In particular, double enveloping worm gears, utilized for many applications in which heavy shock loads are present or where limited backlash is desirable, are presently made from centrifugally cast phosphor gear bronzes. These bronzes generally consist of 9 to 12 w/o (weight percent) tin, up to 1.75 w/o nickel and the balance substantially copper. These alloys are often referred to as phosphor bronzes as a result of up to 0.25 w/o phosphorous being present from deoxidation during liquid metal processing.

Typical requirements for such a gear bronze include 310–345 Mpa (45–50 ksi) ultimate strength, 150–175 Mpa (22–25 ksi) yield strength, and 12% elongation to failure. Gears hobbed from such bronzes exhibit excellent wear resistance in lubricated sliding against steel.

The good wear characteristics of gears made from these gear bronzes have been attributed by some, but not all, researchers to the presence of relatively hard interdendritic phases which are embedded in a relatively tough and soft matrix of alpha phase (Cu-Sn solid solution). For example, it has been reported that increasing amounts of phosphorous in tin bronzes containing nominally 9.5 w/o tin was very effective in reducing the coefficient of friction and the wear rate in a pin on disc experiment. This work showed that increasing P contents (from 0–3 w/o) resulted in increasing amounts of the hard intermetallic $Cu_3P$ phase which was responsible for increased overall hardness and improved wear properties. Tin should have a similar effect on increasing hardness and wear properties.

While this gear bronze does an adequate job in many applications, observations of worm gears used in service show failure occurring by a combination of cracking, pitting and/or spallation. There is thus a desire to reduce and retard the occurrence of these failures in service to prolong gear service life and also to increase the load capability, performance, and efficiency of these gear bronzes.

It is an object of the present invention to provide as-cast, age-hardened Cu-Sn-Ni worm gearing having improved strength and wear properties while retaining reasonable ductility.

It is another object of the present invention to provide a method of making as-cast, age-hardened Cu-Sn-Ni worm gearing having improved strength and wear properties.

It is another object of the present invention to provide such as-cast, age-hardened Cu-Sn-Ni worm gearing which is more resistant to failure in service (e.g., by cracking and/or gross surface degradation such as pitting, spallation and the like) and which improves the load capability of the worm gearing.

SUMMARY OF THE INVENTION

The present invention provides worm gearing comprising a Cu-Sn-Ni alloy age-hardened in the as-cast condition. The Sn and Ni concentrations of the alloy are selected to provide, when the as-cast alloy is age-hardened, a microstructure comprising an age-hardened (strengthened) dendritic constituent (e.g., alpha phase) and typically one or more relatively hard interdendritic constituents (e.g., intermetallic phases). The overall Ni concentration of the alloy is selected so as to substantially avoid formation of a discontinuous, embrittling grain boundary product (e.g., alpha and gamma phases formed by a transformation of the alpha phase) which competes with age-hardening during the age-hardening treatment and is deleterious to wear and strength properties. In other words, Ni is present in the alloy in an amount sufficient to achieve significant age-hardening strengthening of the dendritic constituent but in an insufficient amount to form substantial embrittling grain boundary product during age-hardening.

In accordance with the present invention, the as-cast microstructure of the Cu-Sn-Ni alloy gear is characterized by a dendritic constituent which exhibits as-cast microsegregation (also known as coring) of Sn and Ni thereacross. For example, the dendritic constituent has a higher Ni concentration near the center of each dendrite and a lower Ni concentration near the edge or grain boundary of the dendrite. The lower Ni concentration near the grain boundary is less than the overall or bulk Ni content of the alloy. The present invention has recognized that an age-hardening response is exhibited in spite of retention of the as-cast microstructure which heretofore was not generally thought to exhibit enough super- saturation in the as-cast dendritic alpha phase to promote significant age-hardening response and resultant strengthening. Moreover, the relatively lower amount of Ni at the dendrite edges (grain boundaries) is believed to hinder the formation of the embrittling grain boundary product.

Preferably, the as-cast, age-hardenable gear microstructure is obtained by centrifugal chill casting of a gear blank having a section size capable of being sufficiently rapidly cooled to provide such a dendritic constituent comprising a supersaturated solid solution of Cu-Sn-Ni.

Preferably, the Cu-Sn-Ni alloy comprises about 8.0 w/o to about 13.0 w/o Sn, about 3.5 w/o to about 5.0 w/o Ni and the balance substantially copper (bulk composition) selected to yield the as-cast microstructure/-microsegregation described above. Even more preferably, the alloy comprises about 10.0 w/o to about 12.0 w/o Sn, about 4.0 w/o to about 4.4 w/o Ni and the balance substantially copper. Phosphorous may be present in the alloy as a result of a prior deoxidizing treatment during melting provided the amount of phosphorous is limited to avoid embrittlement of the alloy.

In accordance with the method of the invention for making the worm gearing, the aforementioned Cu-Sn-Ni alloy is cast, preferably centrifugally chill cast, to obtain the desired as-cast dendritic/interdendritic constituents in the microstructure and then the as-cast alloy is age-hardened to strengthen the dendritic constituent while substantially preventing formation of the discontinuous, grain boundary product.

DETAILED DESCRIPTION OF THE INVENTION

Figure 1:
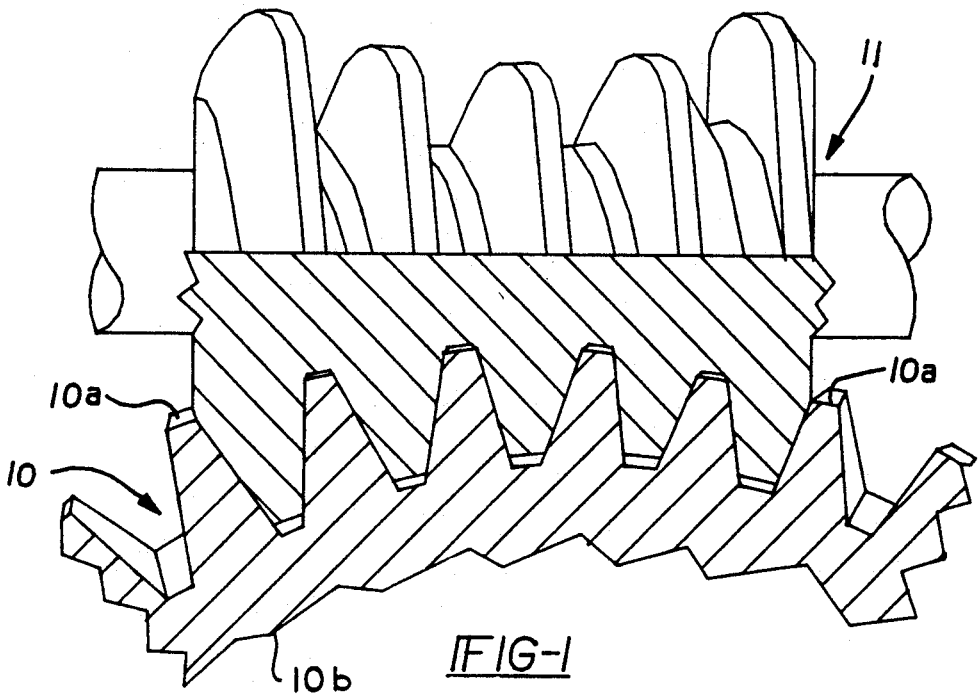
FIG. 1 is a sectioned elevational view of a worm and worm wheel or gear.

FIG. 1 illustrates an as-cast, age-hardened, as-machined (e.g., hobbed) worm wheel or gear 10 which is adapted to mate with a worm 11. To this end, the worm gear 10 includes a plurality of outer teeth 10*a* extending from a central hub 10*b*. Teeth 10*a* are adapted to mesh with the teeth of the worm 11 in well known manner. The worm gear 10 may be various sizes; e.g., 3, 4, 5 and 8 inch C.D. (center distance) nominal sizes of worm gears 10 have been used. "Center distance" corresponds to the distance from the center of the worm gear 10 to the center of the mating worm 11. The present invention is especially advantageous with respect to worm gears 10 of these sizes. As will be explained in detail hereinbelow, rapid cooling of the as-cast worm gear blank is required to provide the desired as-cast microstructure (i.e., supersaturated solid solution dendritic constituent) that is amenable to age-hardening despite Sn and Ni microsegregation thereacross. The section sizes of the worm gear 10 are selected to this end.

The present invention resulted from analysis of failure modes of centrifugally cast worm gears similar to that shown in FIG. 1 but which were made of a known Cu-Sn reference alloy (i.e., 11 w/o Sn and balance substantially Cu). These Cu-Sn worm gears were subjected to actual service or simulated test stand service and exhibited failure of some kind.

Metallographic and microhardness analysis of the failed worm gears revealed considerable in-service work hardening of the teeth corresponding to teeth 10*a*. In particular substantial work hardening was observed on the side faces (or flanks) of the teeth near the leading tooth edge and at the point at which the worm ceases contact with the tooth. Work hardening of the root of the teeth was also observed. However, work hardening of the side faces of the teeth was most noticeable.

Severe spallation and associated fatigue type cracking of the side faces of the teeth were often observed on worm gears used in actual service. As cracking matured below the side face surfaces, the cracks appeared to follow microhardness contours. In worm gears subjected to simulated service in test stands, pitting of the tooth faces was also noted and was associated with cracking in certain crystallographic directions. Root cracking of the worm gears was also observed in all specimens and was attributed to high cycle bending fatigue associated with the teeth during service.

In view of the actual and simulated service failures of these as-cast Cu-11-w/o Sn bronze worm gears, the present invention sought to develop a worm gear having improved strength and wear properties to reduce or retard such failures and thereby to extend gear service life as well as enable increased power ratings for worm gear sets.

In accordance with a preferred embodiment of the present invention, a Cu-Sn-Ni alloy of selected composition set fort below is centrifugally chill cast in the form of a worm gear blank, the blank is age-hardened in the as-cast condition and the age-hardened blank is hobbed, machined or otherwise shaped to the desired final dimensions and configuration for the worm gear 10.

The Cu-Sn-Ni alloy preferably has a bulk composition of about 8.0 w/o to about 13.0 w/o Sn, about 3.5 w/o to about 5.0 w/o Ni with balance substantially copper. Even more preferably, the alloy comprises from about 10.0 w/o to about 12.0 w/o Sn, about 4.0 w/o to about 4.4 w/o Ni with the balance substantially copper. Phosphorous may be present in amounts up to about 0.25 w/o, preferably less than about 0.15 w/o, as a result of its use as a melt deoxidizer.

The Sn concentration is selected to produce a significant amount of relatively hard interdendritic phase. The interdendritic phase(s) may comprise an intermetallic ($Cu_{31}Sn_8$) delta phase and "primary" gamma phase formed from other interdendritic intermetallics upon solidification and cooling of the alloy. The "primary" gamma phase is not to be confused with the discontinuous formation of alpha and gamma phases at grain boundaries by alpha transformation during age-hardening. However, the inventors do not intend to be bound by this characterization of the interdendritic phase(s) since it is difficult to identify the exact phases present. An x-ray line scan should prove beneficial to more particularly identify the interdendritic phase(s). Ni does not appear to have a strong effect on the volume percent of intermetallics at the alloy compositions involved.

The Ni concentration is chosen to be sufficient to foster aging, and thus strengthening, of the as-cast dendritic constituent yet insufficient to yield the undesirable softer, discontinuous, embrittling grain boundary product that can form during age-hardening. As a result, the overall Ni content of the alloy is selected to be between about 3.5 to about 5.0 weight percent (w/o) of the total alloy weight. Limitation of the Ni content in this manner in combination with coring (microsegregation) of Ni in the individual dendrites of the as-cast microstructure is believed to substantially prevent formation of the discontinuous, embrittling grain boundary product during age-hardening of the as-cast gear blank. The overall Ni content of the alloy is preferably between about 4.0 w/o to about 4.4 w/o as indicated above.

The Ni and Sn are thus selected in relation to one another to optimize the as-cast microstructural strength and subsequent strengthening of the dendritic constituent by age-hardening as explained below while retaining reasonable ductility.

If P is present in the Cu-Sn-Ni alloy, the interdendritic phases present in the as-cast microstructure may also include copper phosphides ($Cu_3P$). Nickel or tin phosphides may also be present as interdendritic phases.

In the testing procedure described hereinbelow, a specific test alloy was used having an overall or bulk composition of 10.53 w/o Sn, 4.42 w/o Ni, 0.01 w/o Pb, 0.11 P and balance substantially Cu.

Figure 2:
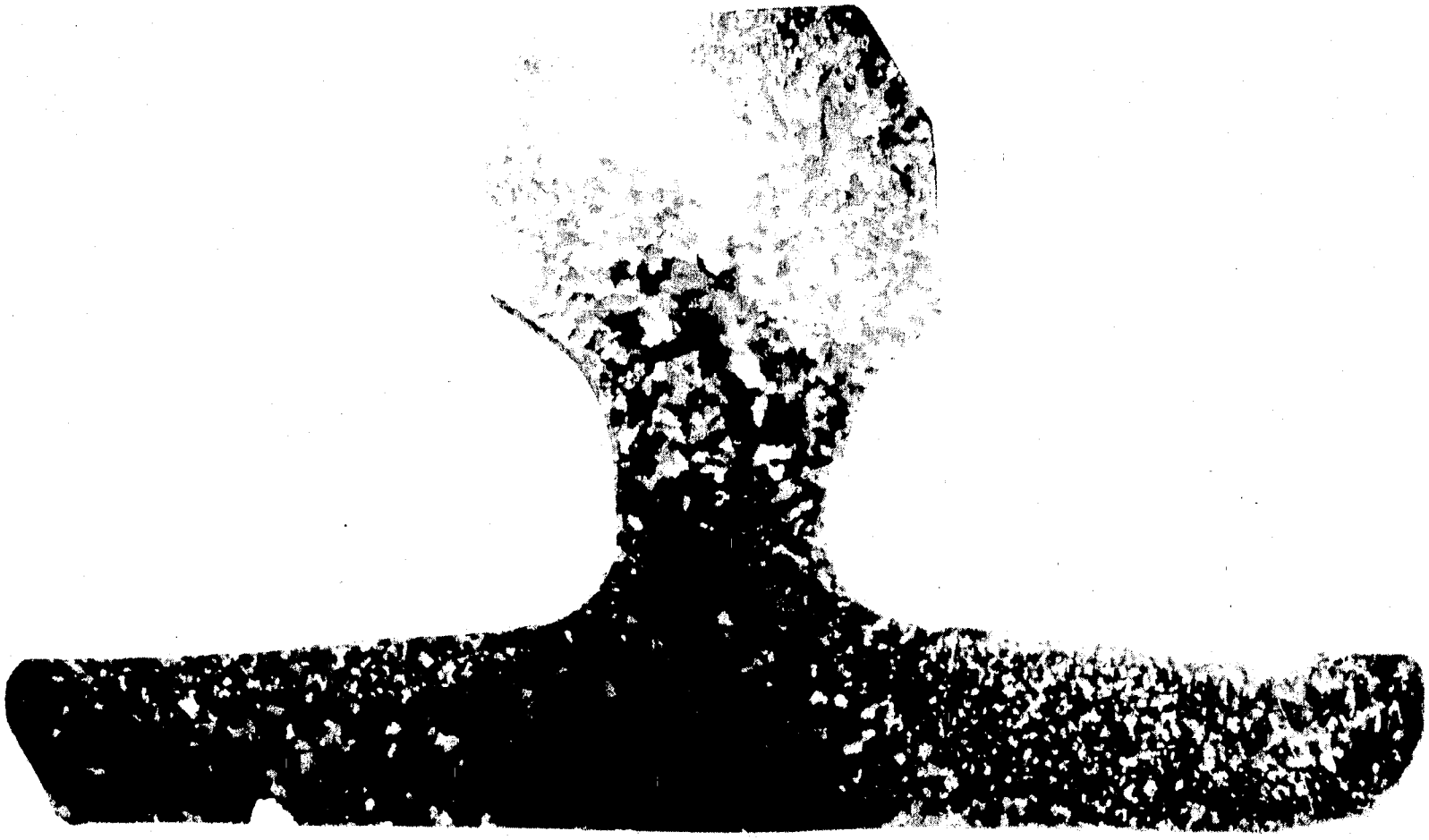
FIG. 2 is a composite photomicrograph at 2.5× of a cross-section of a centrifugally cast worm gear blank of Cu-10.53 Sn-4.42 Ni alloy (etched with 5% $FeCl_3$, 15% HCl and ethanol).
Figure 3:
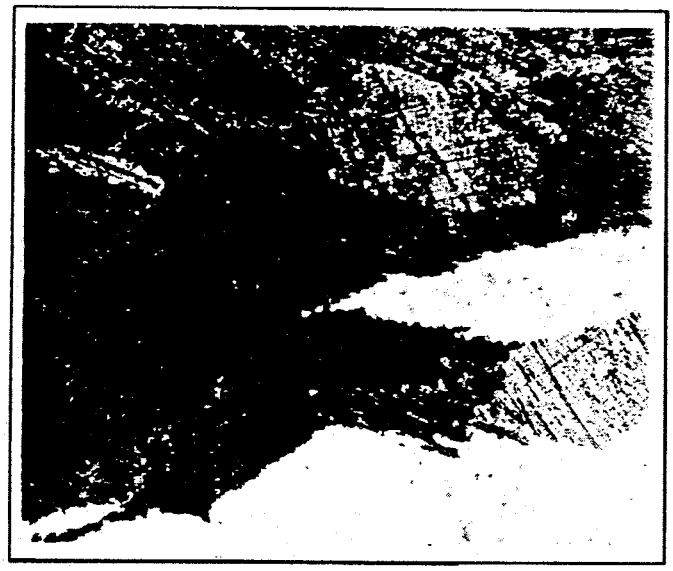
FIG. 3 is a photomicrograph at 31.25× of the columnar zone of the as-cast worm gear blank (etched with 5% $FeCl_3$, 15% HCl and ethanol).
Figure 4A:
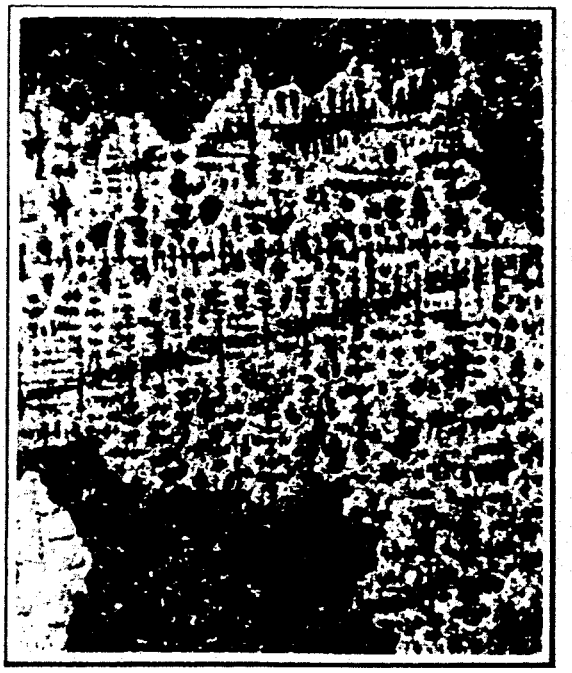
FIGS. 4*a* and 4*b* is a photomicrograph at 62.5× of the equiaxed grain structure of the web of the as-cast worm gear blank (etched with 5% $FeCl_3$, 15% HCl and ethanol).
Figure 4B:
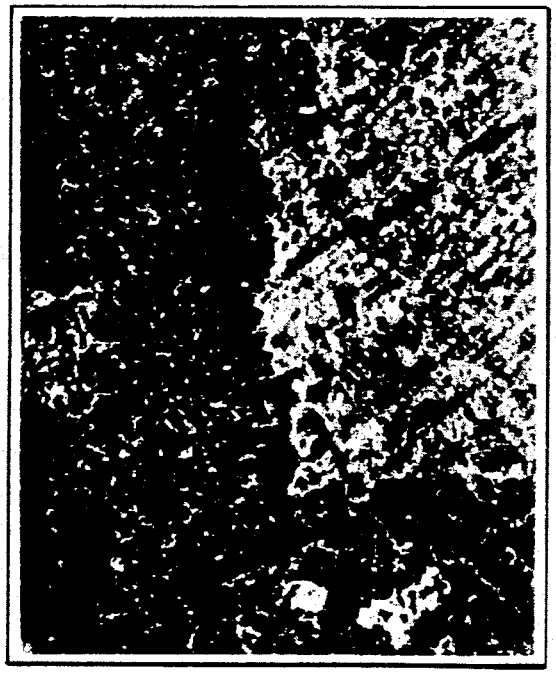
Figure 5A:
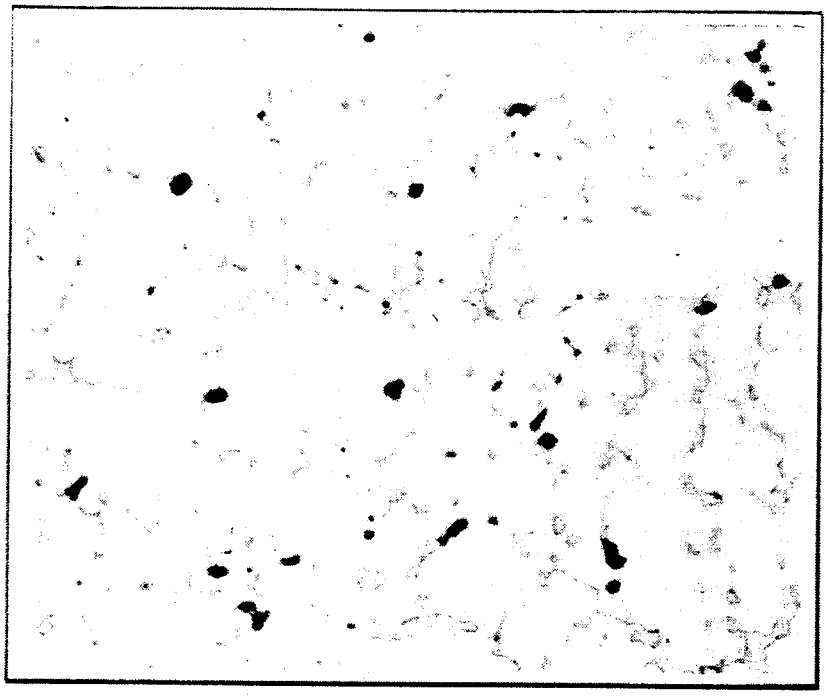
FIGS. 5*a* and 5*b* are photomicrographs taken in the columnar zone (at the center of the flange in the columnar zone) of the as-cast worm gear blank at 250× and 1000×, respectively (etched with 5% $FeCl_3$, 15% HCl and ethanol).
Figure 5B:
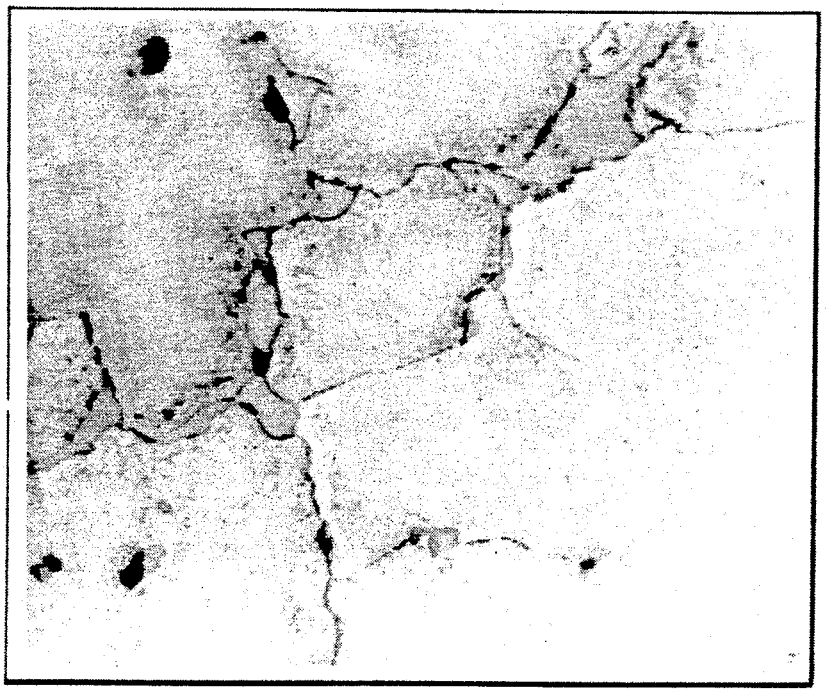

The Cu-Sn-Ni test alloy was centrifugally cast to form a worm gear blank suitable for machining into the worm gear 10 with teeth 10*a* (a cross-section of the as-cast blank is shown in FIG. 2). The worm gear blanks were centrifugally chill cast by Wisconsin Centrifugal Corp.

As mentioned hereinabove, the size (e.g., the section size) of the worm gear blank is selected in conjunction with the particular casting method employed (centrifugal chill casting in this instance) to provide a relatively rapid cooling rate to yield an as-cast microstructure having (a) fine dendritic constituent (i.e., secondary dendrite arm spacing of about 14 to about 25 micrometers, typically about 20 micrometers ($8\times10^{-4}$ inch)), that is a supersaturated Cu-Sn-Ni solid solution (corresponding to the alpha phase) and (b) typically having relatively hard interdendritic phases. Photomicrographs of the as-cast microstructure are shown in FIGS. 2, 3, 4*a*, 4*b* and 5*a*, 5*b*.

The cooling rate will vary with location on the casting due to section size differences. The cooling rate at the outer portion of flange 10*c* (where fine equiaxed grains are present, FIG. 2) is generally approximated to be between about 1875° F./sec to about 3250° F./sec. The cooling rate at inner portion of the flange 10*c* (where columnar grains are present) is generally approximated to be between about 530'F./sec to about 925° F./sec. The web 10*d* (equiaxed grains) is approximated to have experienced a cooling rate between about 1340° F./sec to about 2340° F./sec. These cooling rates were estimated based on mathematical models and data set forth by Donald R. Askeland in *The Science and Engineering of Materials*, 1989, and on data in the *Metals Handbook*, Vol. 9, 9th Ed., American Society for Metals, 1985. As a result, the cooling rates set forth are only estimates or approximations based on these models.

Control of the Ni concentration of the alloy in an overall sense and in the microscopic sense is believed important to avoid formation of substantial amounts of the undesirable discontinuous, embrittling grain boundary product described hereinabove which reduces ductility and apparently forms by transformation during age hardening (i.e., alpha→alpha+gamma) and competes with the age-hardening reaction described hereinafter. This embrittling grain boundary product appears to nucleate at grain or interdendritic boundaries and eventually can engulf the microstructure with time at the aging temperature employed.

On a macroscopic scale, the Sn and Ni content was found to vary across the as-cast worm gear blank. For example, the Sn content of the blank hub 10*b* was determined to be higher (by about 7.1%) than the Sn content of the flange 10*c*. In contrast, the Ni content was higher (by about 7.7%) at the blank flange 10*c* than at the hub 10*b* (e.g., 4.41 w/o Ni at the flange versus 4.07 w/o Ni at the hub).

Optical analysis of the as-cast worm gear blank, FIG. 2, showed that grain size and distribution were similar to that of a similarly cast Cu-11 w/o Sn phosphor bronze.

Three zones of grains appear to be present in the as-cast worm gear blank; namely, the chill zone having small grains at the periphery of the as-cast worm gear blank, the columnar zone with longer radially oriented grains proximate the top of the flange 10*c*, and the equiaxed zone at the base of the flange 10*c* and at the center of the web 10*d*. Those skilled in the art will recognize that the gear teeth 10*a* are machined primarily from the aforementioned columnar zone of the worm gear blank.

The quantity of interdendritic phases in the as-cast microstructure of the Cu-Sn-Ni test alloy was measured by a systematic point count and was determined to be about 4.33 v/o. This amount is lower than the amount (about 10–15 v/o) observed in the similarly cast Cu-11 w/o Sn alloy mentioned above. By energy dispersive x-ray analysis in the scanning electron microscope, at least three (3) interdendritic phases were found in the as-cast microstructure of the Cu-Sn-Ni test alloy. A list of the analyses taken on several different microconstituents is shown in Table I. Because of the nature of this test, compositions indicated are only semi-quantitative; i.e., they are often confounded with x-rays which come from material lying below the particle being inspected.

TABLE I

| Micro-constituent | Cu wt % | Sn wt % | Ni wt % | P wt % | S wt % | Si wt % |
|---|---|---|---|---|---|---|
| Dark Dendritic | 82.47 | 10.21 | 3.88 | — | — | — |

TABLE I-continued

| Micro-constituent | Cu wt % | Sn wt % | Ni wt % | P wt % | S wt % | Si wt % |
|---|---|---|---|---|---|---|
| White | 71.74 | 24.81 | 3.44 | | | |
| Light Gray | 73.22 | 23.63 | 3.15 | — | — | — |
| Dark Gray* | 70.54 | 13.02 | 3.41 | 5.18 | — | 7.81 |
| Black* | 25.67 | 44.67 | 4.57 | 7.82 | 17.27 | — |

*These microconstituents are probably due to deoxidizer present

Colors referred to in Table I refer to colors visible on the scanning electron microscope screen. It is apparent that some phosphides and sulfides are also present. The formation of the phosphide, $Cu_3P$, is expected from P retained after deoxidizing. Silicon is thought to be present only as a result of metallographic preparation. From the ternary Cu-Sn-Ni phase diagram, interdendritic constituents would be expected to consist of alpha and "primary" delta/gamma phases.

The as-cast microstructure of the Cu-Sn-Ni worm gear blank thus comprised a fine, cored dendritic constituent (i.e., alpha phase) with relatively hard interdendritic phases retained between the dendrite constituent and with little or no discontinuous, alpha plus gamma phase grain boundary product.

Importantly, microsegregation (also called coring) was observed within the as-cast dendritic constituent. In particular, the Sn and Ni concentrations of individual dendrites were observed to vary significantly across the dendrite arms with the Sn content varying the greatest across a dendrite arm. Namely, the Sn concentration was found to vary from about 13 w/o at the outer edge (grain boundary) of a typical dendrite arm to only about 4.4 w/o at the center of a dendrite arm. The Sn concentration along the length of the dendrite arm showed a similar trend or variation.

The variation (as-cast microsegregation) of Ni concentration across individual dendrites was observed to be opposite to that of Sn variation. Namely, Ni concentration varied from about 5.0 w/o at the center of a typical as-cast dendrite arm to only about 3.6 w/o at the outer edge (grain boundary). The Ni concentration along the length of the dendrite arm showed a similar trend or variation.

The present invention involves the recognition that the dendritic constituent of the as-cast microstructure can be subsequently age-hardened to provide significant strength improvements in spite of the belief heretofore that the as-cast dendritic constituent did not exhibit sufficient supersaturation to promote significant age-hardening response. Moreover, the present invention involves the recognition that, for the alloy composition described above, the microsegregation (coring) present in the dendritic constituent, in particular, the Ni coring across the dendritic constituent, (i.e., a relatively low Ni at the grain or interdendritic boundaries less than the overall or bulk Ni content of the alloy) appears to hinder formation of the deleterious, discontinuous, embrittling grain boundary product formed by transformation of alpha phase during age-hardening. Moreover, the present invention recognizes that age-hardening of the as-cast microstructure without an intermediate homogenizing heat treatment produces the desired age-hardening response without promoting the formation of the undesirable, discontinuous grain boundary product.

Figure 6:
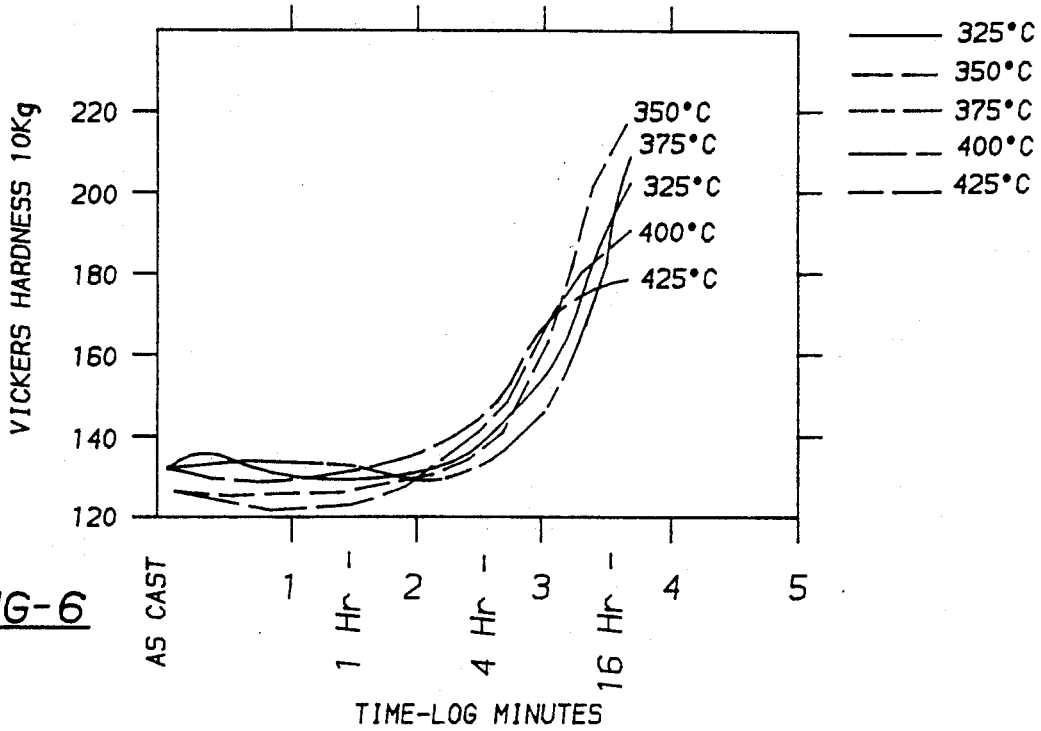
FIG. 6 is a composite plot of the hardness response with time of age-hardening for various age-hardening temperatures.

As a result, the method of the invention involves subjecting the as-cast worm gear blank to an age-hardening treatment to improve strength and wear properties without subjecting the as-cast gear blank to an intermediate homogenizing heat treatment. A preferred age-hardening treatment is conducted in the temperature range from about 325° C. to about 350° C. for about 4½ hours to about 8½ hours, although other time and temperature combinations may be used. Spinodal decomposition is the suspected hardening mechanism by which the dendritic alpha phase decomposes to form alpha prime and alpha double prime phases within the dendritic matrix during the age-hardening treatment. A composite plot of the hardness response with time is shown in FIG. 6.

As is apparent, the greatest hardness increase for an aging time greater than 8 hours was experienced for the test sample aged at 350° C. Because none of the plots displays a negative slope up to the 24 hour time limit of the aging treatment, all of the test samples appear to be under-aged. Observation of the plot of the test sample aged at 24 hours indicates that it may have been approaching peak hardness for that temperature.

Figure 7:
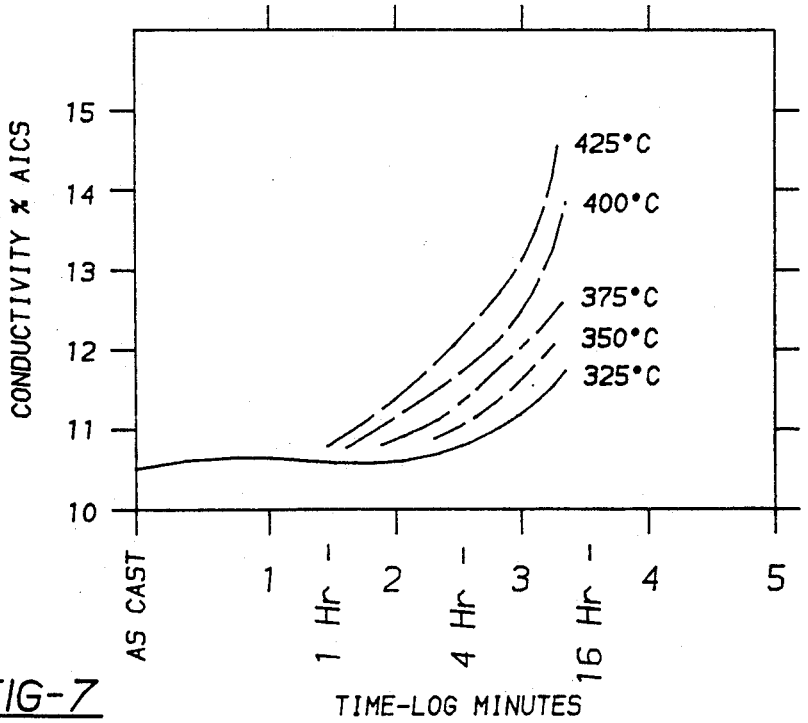
FIG. 7 is a composite plot of the electrical conductivity response with time of age-hardening for various age-hardening temperatures.
Figure 8A:
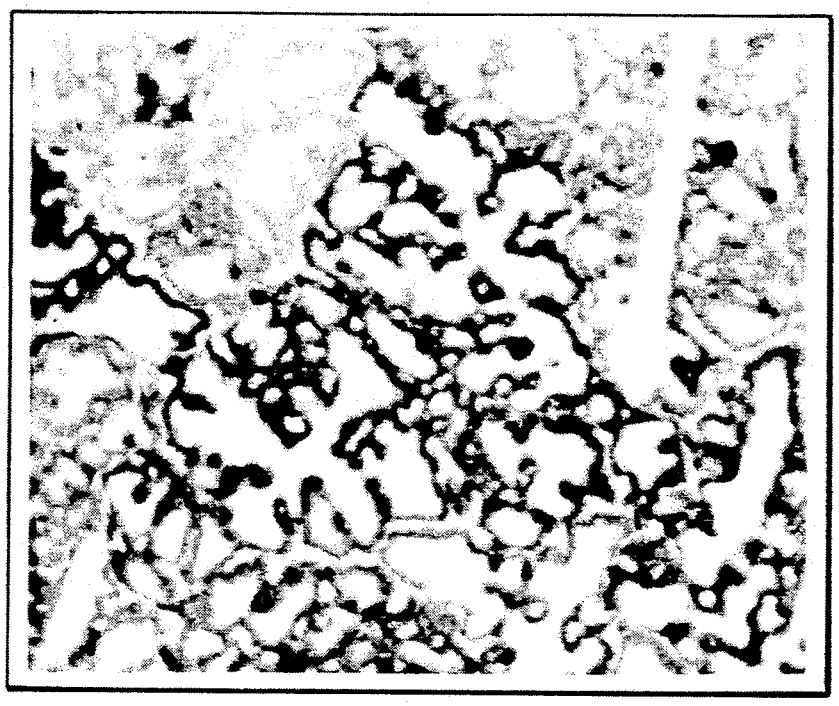
FIG. 8*a* and 8*b* is a photomicrograph at 250× and 1000×, respectively, of the as-cast, age-hardened alloy (aged at 425° C. for 24 hours).
Figure 8B:
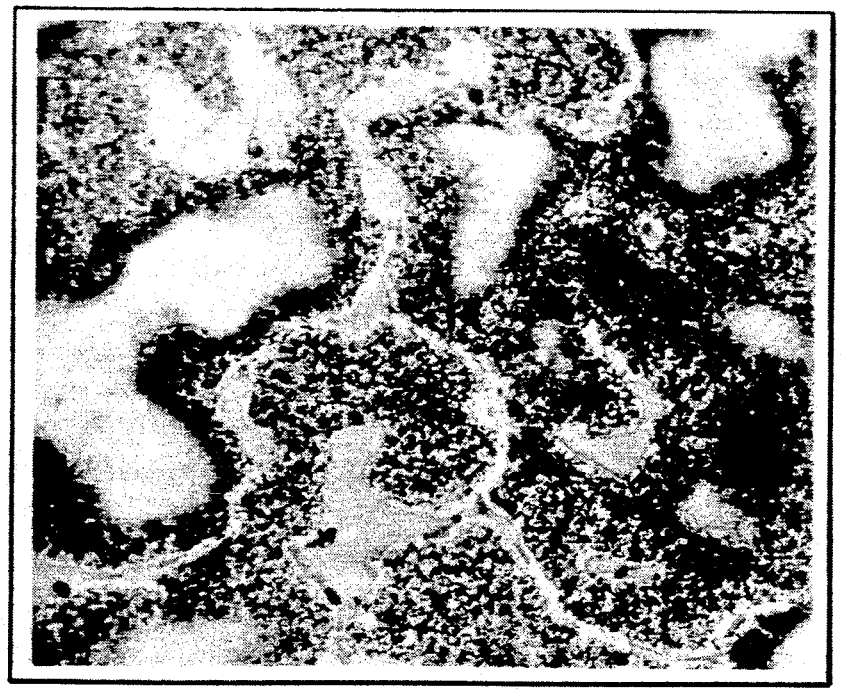

Electrical conductivity response with time of aging was observed to be similar to that of hardness as shown in FIG. 7. The sensitivities of both hardness and electrical conductivity responses suggest that those measurable properties may be used for quality control purposes.

The age-hardening heat treatments had a relatively small effect o the microstructure of the test alloy from the standpoint that the dendritic structure is retained, the interdendritic material is unchanged and importantly no discontinuous, embrittling grain boundary product is formed as a result of the heat treatments. For example, it can be seen by comparing FIG. 8*a*,8*b* to FIG. 5*a*,5*b* that aging as long as 24 hours at 425° C. caused no formation of the undesirable discontinuous, grain boundary gamma phase, which would appear as a step-like or jagged, lamellar structure growing from the grain boundaries. None of this grain boundary product was observed even after the aging treatment at 425° C. for 24 hours.

The difference in visual appearance between FIG. 5*a*,5*b* and FIG. 8*a*,8*b* resulted from more aggressive, non-uniform attack of the age-hardened alloy vis-a-vis the as-cast alloy by the etching solution.

Since the maximum response to aging occurred at 350° C., one wear test alloy specimen was prepared by aging at 350° C. for 4½ hours and another wear test alloy specimen was prepared by aging at the same temperature for 8½ hours. Two additional wear test alloy specimens were aged at 325° C. for respective 4½ hour and 8½ hour periods for comparison purposes.

Moreover, one solution treated (homogenized) wear test alloy specimen was prepared by heating an as-cast specimen at 780° C. for 8½ hours. The solution treatment, however, was found to be an unviable treatment because numerous radial intergranular surface cracks were noticed in the flange 10*c* (the region where teeth are cut) of the cast worm gear blank and were associated with a grain boundary product which whetted the grain boundaries in this region of the gear blank. This observed grain boundary product may comprise phosphides due to incomplete solutionization and some of the grain boundary product mentioned hereinabove resulting from inability to quench the gear blank fast enough. Preliminary x-ray analyses on a scanning electron microscope have shown high levels of phosphorous, some nickel and trace amounts of lead in these intergranular products.

Wear testing was performed on a surface fatigue machine which employed lubricated sliding. This machine was used to determine wear rates and surface fatigue characteristics.

The surface fatigue machine was designed to cause accelerated wear of the specimen while mimicking the actual load history of a worm gear. In this machine, four hard, cylindrical stationary sliders 20 (one shown in FIG. 9) were imposed on a rotating specimen 21 machined from the cast gear blank to a configuration shown in FIG. 9 having simulated gear teeth 21*b*. The sliders 20 were spaced circumferentially 90° apart. Each slider was oriented such that its cylindrical surface was in contact with the upper surface 21*a* of the test specimen 21. The specimen 21 was mounted on a rotatable splined arbor 29. Tapered roller bearing assemblies were positioned on the arbor 29 above and below the specimen 21 for rigidity. Material loss, measured by change in thickness, and cycles required to attain pitting and/or spalling were obtained from material loss.

Carbonized steel sliders 20 were imposed against each specimen 21 in order to cause wear of the top surface 21*a*. Four sliders were employed in order to accelerate the test by increasing the number of surface fatigue cycles per revolution of the specimen.

Care was taken to ensure that the test environment was as similar as possible to that experienced by gears in a commercial test stand that simulates actual service. A control temperature was, therefore, maintained at about 180° F. (82.5° C.). Fluctuations of 10° F. (5.5° C.) were generally accepted. A cast iron gear housing with both a heater and cooling coils was used to enclose the tests. Temperature input to the controller was obtained from a probe extending just under the test sample. A thermistor connected to a LED readout was used to monitor the control temperature.

In tests whose steady-state running temperatures were at or near to the 180° F. (82.5° C.) control temperature, cycling between the heater and cooling water was continued throughout the duration.

Wear tests were performed while the specimen 21 and sliders 20 were immersed in a thick steam cylinder oil produced from rendered animal fats. The grade of oil used, Kendall Kendco 155, is presently recommended as the lubricant for commercial worm gears. The lubricant was changed and the machine was wiped out before each test. During each test, the lubricant picked up a brassy tone due to entrained wear debris. After each test, a thick sludge of oil and wear debris was commonly found on the bottom of the test housing.

The speed of the test specimen 21 was held constant at 600 revolutions per minute. This translates to a surface speed of approximately 1000 feet/minute (305 meters/minute). This is a representative speed at which some gears may operate, speeds up to 2000 feet/minute (610 meters/minute) being typical.

Figure 9:
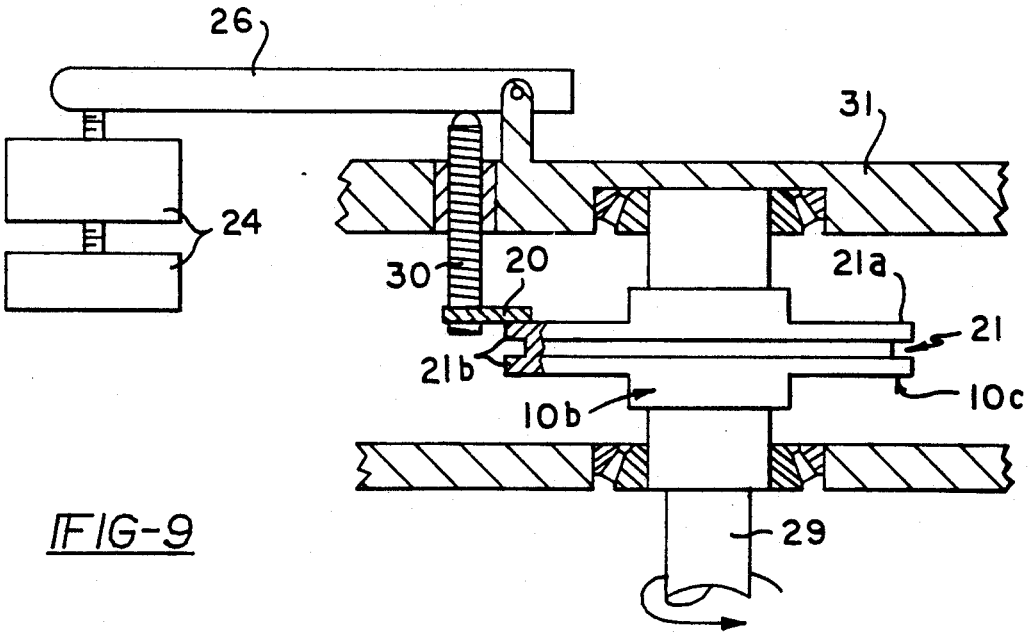
FIG. 9 is a schematic perspective view of the surface fatigue machine used in testing wear properties.

Loading of each slider 20 was performed by rigidly mounting weights 24 on an individual cantilever arm 26, FIG. 9. A 10 pound load was used in conducting the comparative wear testing of the test specimens. The load was applied to each slider 20 via a vertical plunger 30 slidably mounted in a fixed support plate 31. Each slider 20 is attached to its plunger 30 by means of a set screw.

All of the annular test specimens were machined on a lathe from actual worm gear blanks adapted for use as 4 inch C.D. (center distance) worm gears. The reference alloy described above was also used to provide comparative wear test specimens.

The wear testing procedures employed were broken down into pre-test procedures, intermittent procedures, and post-test procedures as follows.

Pre-test Procedures:

1. Vickers hardness was measured on several positions on the specimen.
2. Four equally spaced circumferential positions on the specimen were marked with a punch.
3. Thickness of the test specimen at the four positions was measured and recorded.
4. The test blank was placed on the arbor 29 in the test machine.
5. Four new sliders 20 were installed (or sliders were turned to expose new surface).
6. The top tapered bearing was placed on the arbor 29 on top of the test specimen 21.
7. Fresh lubricant was added to just under but not touching the top tapered bearing.
8. The machine housing was closed. The heater was turned on. The machine was run for a few hours with no load to warm up the lubricant to around 140° F. (60° C.).
9. Machine was stopped and one slider (still without load) was allowed to ride on the top surface 21*a*. A run-out indicator mounted to a stand was positioned against the plunger 30, FIG. 10, of the lowered slider 20. Height fluctuation, measured to an accuracy of 0.0001 inch of the top surface at each of the four marked positions, was recorded.
10. The machine was started and the weighted sliders were lowered and a counter was turned on.

Intermittent Procedure:

1. At preselected times (usually ¼, ½, ¾, 1, 1½, 2, 2½, 3 . . . up to 7 million revolutions) the load was removed and the counter stopped.
2. The test specimen was removed and wiped clean.
3. The specimen was cooled to room temperature with/cold water and wiped dry.
4. The top surface 21*a* was inspected. Thickness of the test specimen at each of the four marked positions was measured to 0.0001 inch and recorded.
5. The test specimen was returned to the machine with the specimen located in the same orientation on the arbor 29.
6. The machine was re-assembled and closed.
7. The machine was started, the weights lowered, and the counter started.

Post-Test Procedure:

1. The test specimen was removed, wiped, cooled, dried, inspected, and measured as before.
2. The width of the worn top surface 21*a* was measured to 0.001 inch.
3. The width (chord length across cross section) of the wear on the sliders was measured to 0.001 inch.
4. The lubricant was drained from the machine. Bronze laden sludge was removed and saved. The machine was wiped dry.

Figure 10:
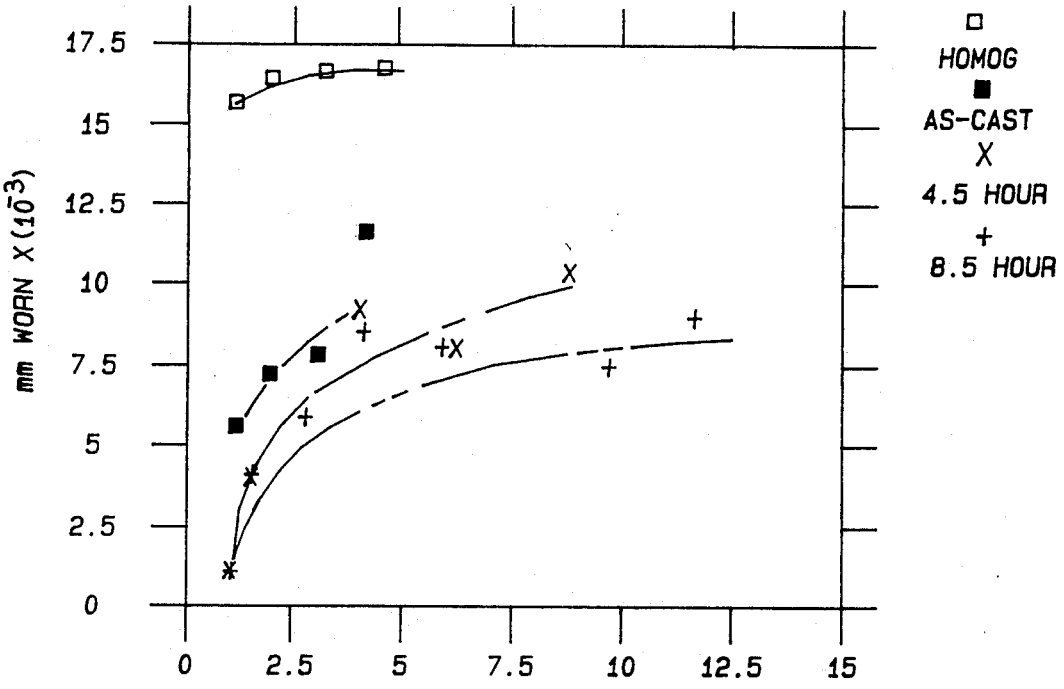
FIG. 10 is a composite plot of wear rate versus cycles for as-cast specimens ages at 325° C. for different times (i.e., 4.5 and 8.5 hours) compared to an as-cast specimen and homogenized specimen.
Figure 11:
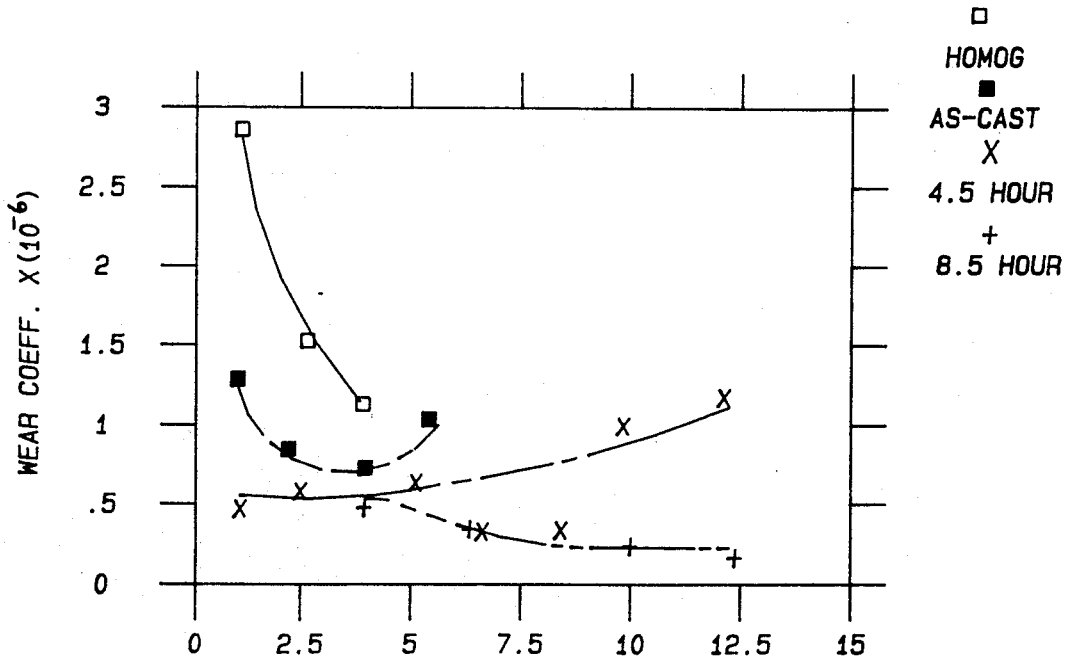
FIG. 11 is a composite plot of wear coefficient versus cycles for as-cast specimens ages at 325° C. for different times (i.e., 4.5 and 8.5 hours) compared to an as-cast specimen and homogenized specimen.
Figure 12:
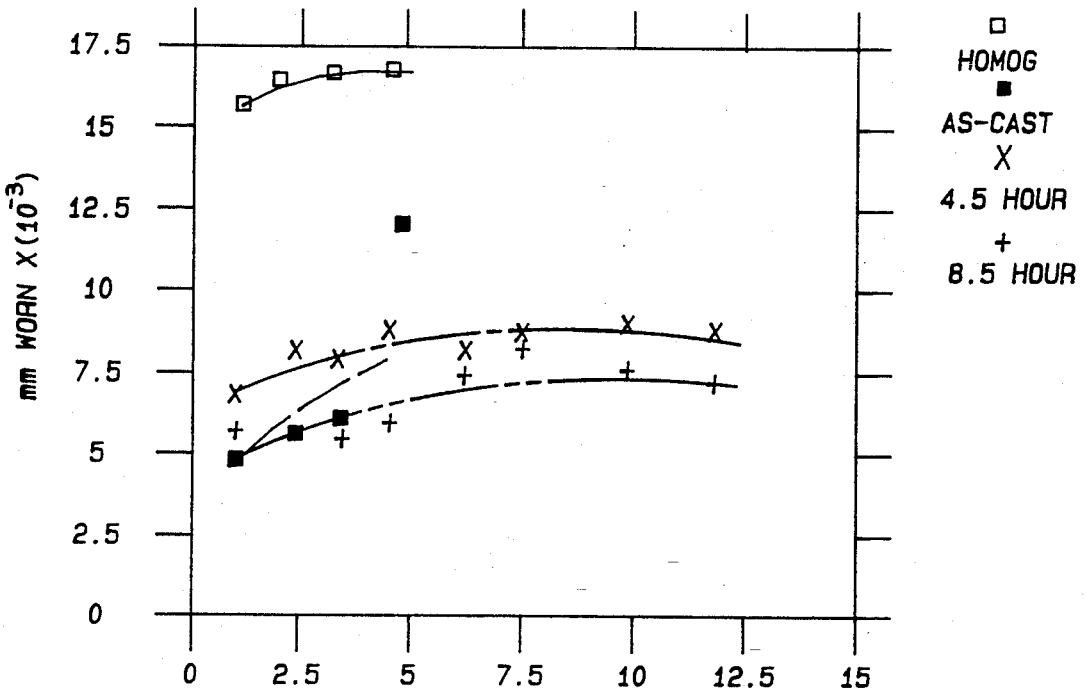
FIG. 12 is a composite plot of wear rate versus cycles for as-cast specimens ages at 350° C. for different times (i.e., 4.5 and 8.5 hours) compared to an as-cast specimen and homogenized specimen.
Figure 13:
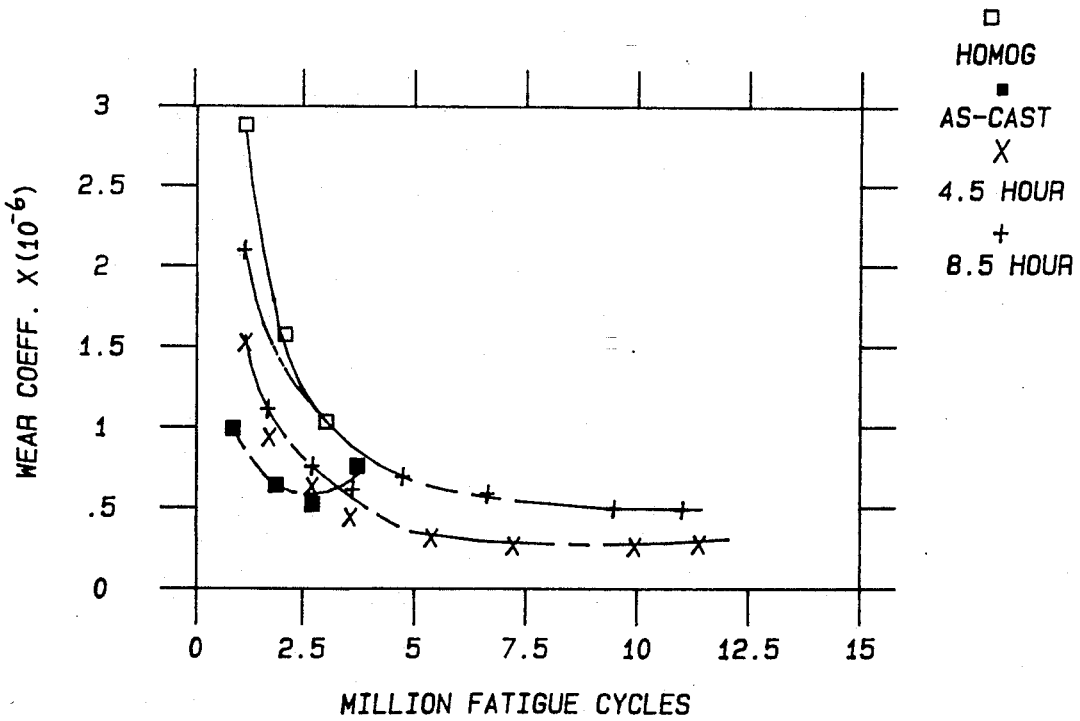
FIG. 13 is a composite plot of wear coefficient versus cycles for as-cast specimens ages at 350° C. for different times (i.e., 4.5 and 8.5 hours) compared to an as-cast specimen and homogenized specimen.
Figure 14:
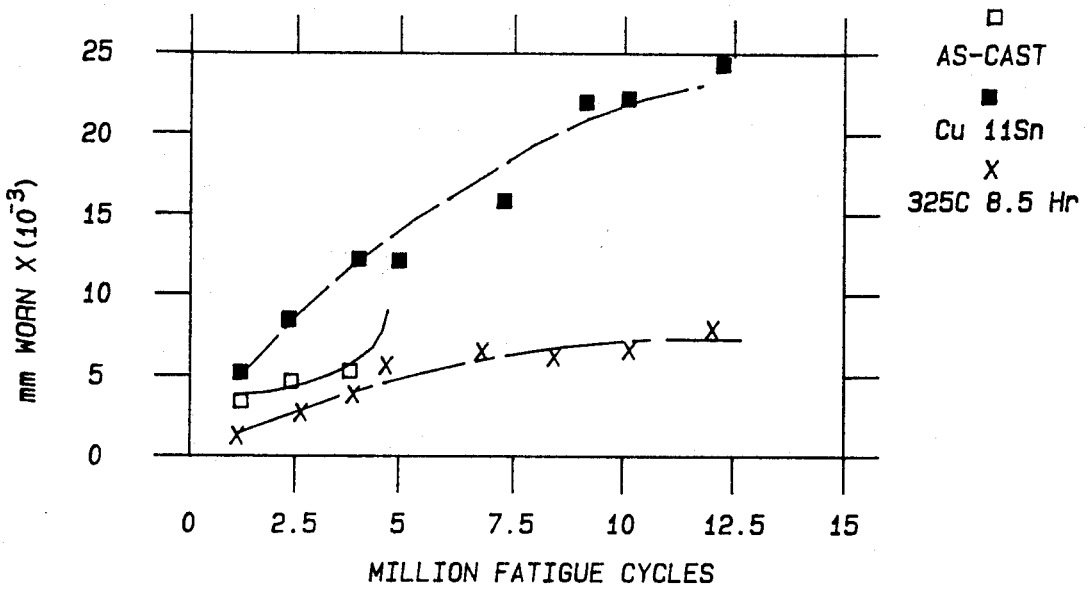
FIG. 14 is a comparison of wear rate for the as-cast test alloy (Cu-10.53 Sn-4.42 Ni) age-hardened at 325° C. for 8.5 hours versus wear rate of Cu-11 w/o Sn reference alloy.
Figure 15:
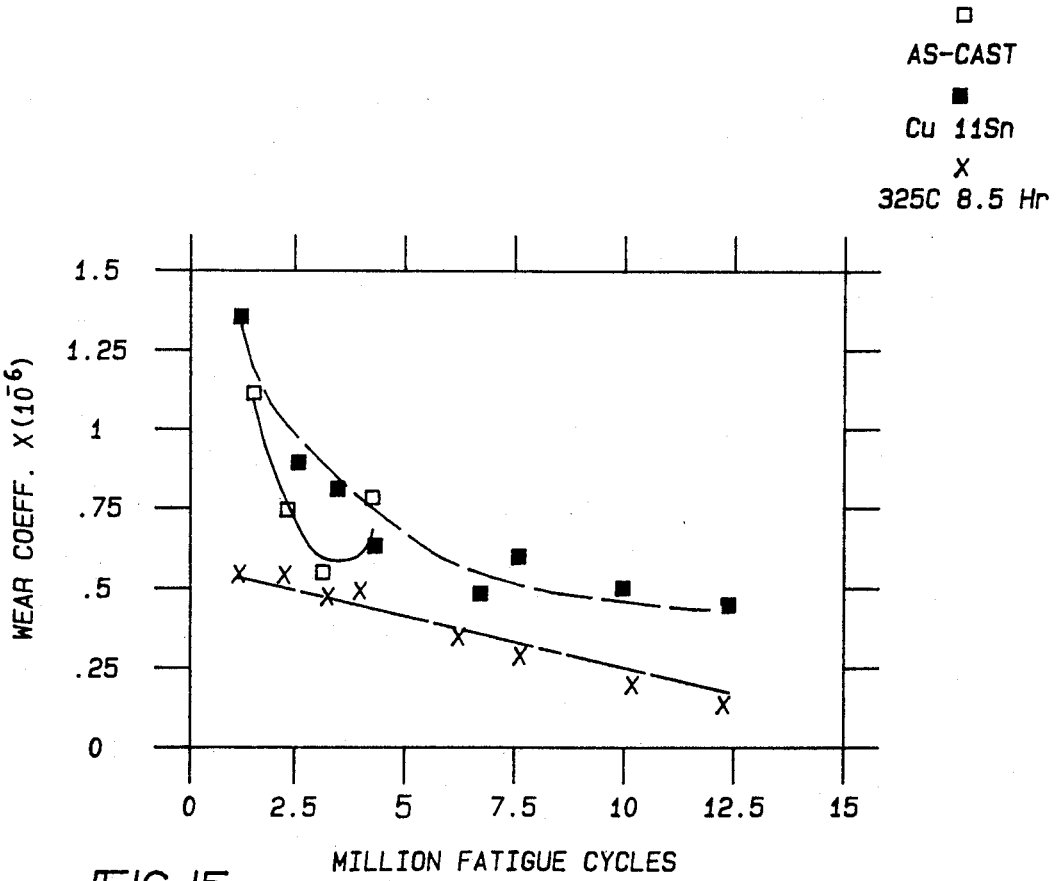
FIG. 15 is a comparison of wear coefficient for the as-cast test alloy (Cu-10.53 Sn-4.42 Ni) age-hardened at 325° C. for 8.5 hours versus wear rate of Cu-11 w/o Sn reference alloy.

Comparisons of wear rates among as-cast, age-hardened test alloy specimens at both 325° C. and 350° C. are given in FIGS. 10 and 12. Corresponding responses of the wear coefficient to age-hardening are given in FIGS. 11 and 13. Overall comparison of the Cu-10.53 w/o Sn-4.42 w/o Ni test alloy to the Cu-11 w/o Sn reference alloy is shown in FIGS. 14 and 15.

It is apparent that wear coefficients obtained were on the order of $10^{-6}$ after reasonable break-in. This appears to be reasonably consistent with published wear coefficients for lubricated sliding of partially compatible metals where wear coefficient values of $10^{-5}$, $10^{-6}$, and $10^{-7}$ are typical of poor, good, and excellent lubrication between partially compatible metals. Wear coefficient is calculated from the equation $$K = \frac{W \cdot H}{d \cdot l}$$

where W is volume of wear in $mm^3$, d is distance slid in mm (d equals $2 \cdot \pi \cdot rn$ where r is radius of track on disk specimen in mm and n is # of revolutions), L is load in Kg, and H is Vickers hardness in $Kg/mm^2$.

There appeared to be a small change in wear rate for the aging treatment temperatures used. For the specimens aged at 350° C. there appears to have been a slight increase in wear rate, especially with the test specimen aged for 8½ hours. Conversely, for the test specimens age-hardened at 325° C., there appears to have been a slight decrease in wear rate. The best wear response observed was for the test specimen age-hardened at 325° C. for 8½ hours.

The wear rate for the homogenized sample appeared to be much higher initially than either the as-cast or as-cast age-hardened test alloy specimens. However, it appeared that the wear rate of the homogenized specimen was lower after the initial break-in period.

Trends of the wear coefficient response (FIG. 15) were similar to those of the wear rate. With the wear coefficients, however, the sensitivity to age-hardening or homogenization was not as pronounced. This would be expected because the wear coefficient is calculated by dividing the wear rate by hardness.

In comparison to the Cu-11 w/o Sn reference alloy (FIGS. 14 and 15), the responses of both the wear rate and wear coefficient were better for the as-cast test alloy specimen and all of the age-hardened test alloy specimens. As seen in the overall comparisons, the wear rate for the test alloy specimen aged at 325° C. for 8½ hours was less than half of that for the Cu-11 w/o Sn alloy. As seen previously, the wear coefficient was not as sensitive to aging treatment as was the wear rate.

Appearances of top surfaces 21*a* of test specimens showed two general trends. The first was that of smooth glossy surfaces with gross surface degradation such as pits or spalls. Such glossy surfaces were seen in the early stages of testing for all specimens tested. Surface degradation, when present, was not noticed until the later stages of testing. The second general trend observed in testing was the formation of scored surfaces. However, this scoring was possibly linked with the deterioration of the sliders.

Tensile specimens were machined from the test specimens after wear testing to permit correlation between wear results and tensile results. The tensile specimens were machined from the web 10*d* of the annular wear test specimens in a direction perpendicular to the radial direction.

Figure 16:
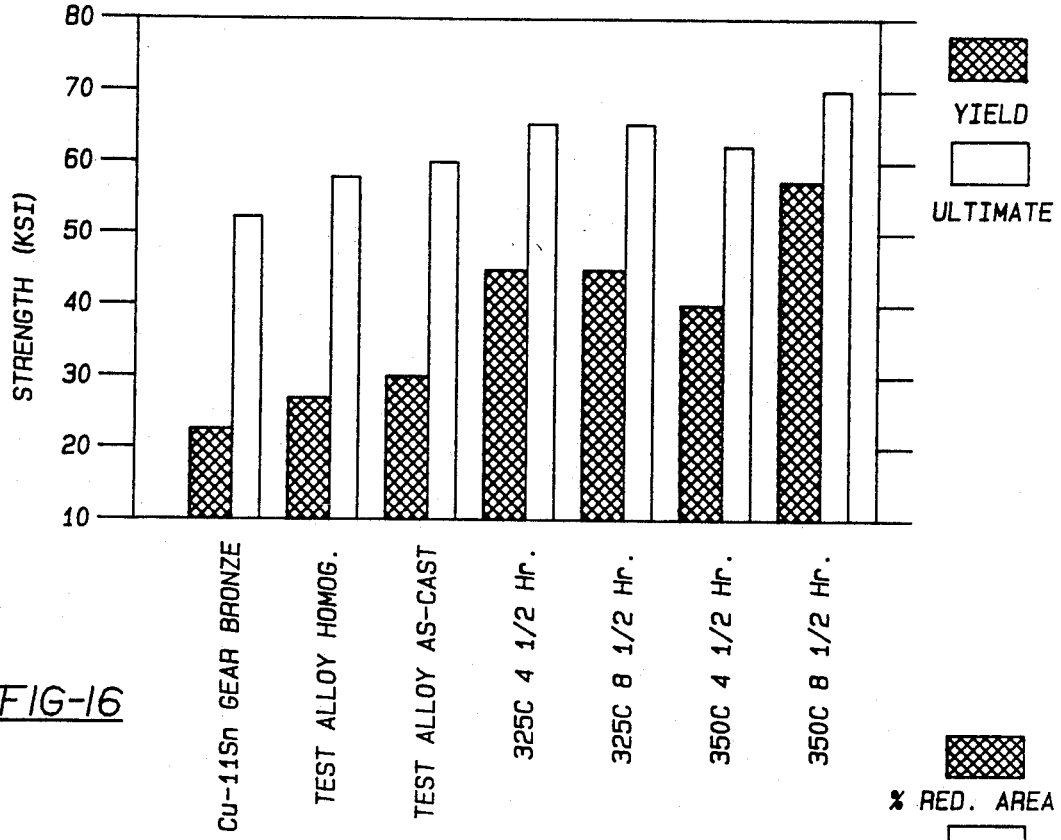
FIG. 16 is a bar graph of the test alloy illustrating variation of tensile strength with age-hardening treatment compared to as-cast and homogenized test alloy as well as the Cu-11 w/o Sn reference alloy.
Figure 17:
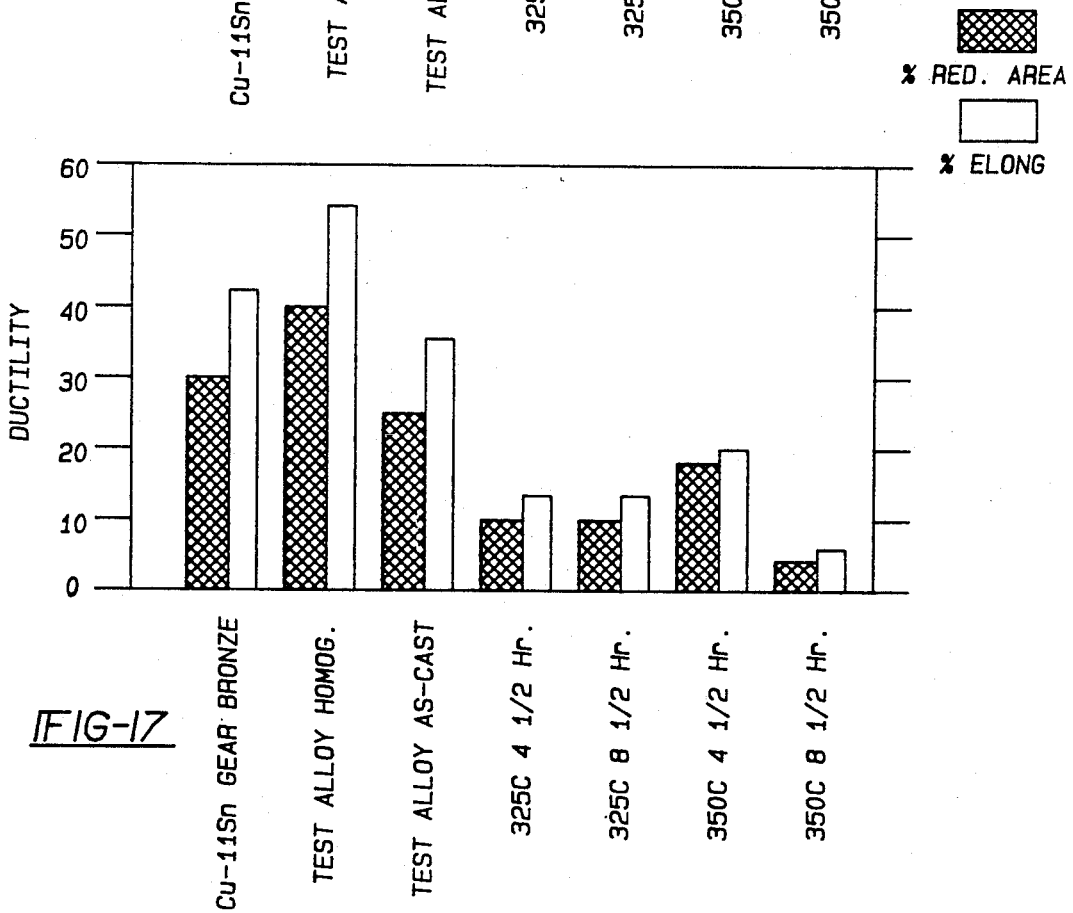
FIG. 17 is a similar bar graph illustrating ductility variations for the same alloys as shown in FIG. 16.

It can be seen from the strength and ductility graphs (FIGS. 16 and 17) that a significant increase in both yield strength and ultimate tensile strength was imparted to the as-cast test alloy specimens that were age-hardened. This increase in strength was accompanied by an expected loss of ductility, although it should be noted that ductility exceeded 10% for all aging treatments (except the 8½ hour treatment at 350° C.). The tensile strength of the homogenized test alloy specimen was almost the same as that of the as-cast test alloy specimens.

In comparison of the wear tests and tensile tests, the peak wear resistance does not necessarily correspond to the peak tensile strength. In fact, the strongest test alloy specimen tested (as-cast, aged at 350° C. for 8½ hours) appeared to have a slightly greater wear rate than did the as-cast test alloy specimen. The lowest wear rate was observed in the test alloy specimen aged as-cast at 325° C. for 8½ hours. However, the differences among some of the wear results were not great and these differences may be due simply to normal variance in specimens.

The present invention thus provides as-cast Cu-Sn-Ni worm gearing (i.e., a worm gear blank or machined worm gear) having a selected composition sufficiently responsive to age-hardening in the as-cast condition (by virtue of the supersaturated solid solution dendritic constituent and the presence of adequate Ni) to significantly reduce wear rate and wear coefficient with minimal or no discontinuous, embrittling grain boundary product formed during the age-hardening treatment. The as-cast Cu-Sn-Ni worm gearing has bee found to exhibit this age-hardening response despite retention of the as-cast dendritic constituent which heretofore was not generally thought to exhibit enough supersaturation to promote an adequate age-hardening response. The best wear rate and wear coefficient resulted from aging the as-cast test alloy at 325° C. for 8½ hours. Also, both yield strength and ultimate tensile strength are increased while retaining significant ductility (i.e., there is only a slight loss in ductility).

Those skilled in the art will appreciate that the invention has been described in detail hereinabove with respect to worm gears, the invention is not so limited and may be useful with other types of gearing. Moreover, while certain preferred embodiments of the invention have been described in detail hereinabove, those familiar with this art will recognize that various modifications and changes can be made therein for practicing the invention as defined by the following claims.

I claim:

1. A method of making worm gearing comprising the steps of:

a) centrifugally chill casting a Cu-Sn-Ni alloy melt comprising about 8 to about 13 weight % Sn and about 3.5 to about 5.0 weight % Ni and the balance substantially Cu to a section size providing a cooling rate effective to provide an as-cast microstructure comprising a dendritic constituent characterized by Sn and Ni in supersaturated solid solution and by as-cast microsegregation of the Ni across individual dendrites such that the Ni content decreases from the dendrite interior to the grain boundary of the dendrite, and b) age-hardening the as-cast alloy under temperature and time-at-temperature conditions effective to strengthen the dendritic constituent while substantially preventing formation of embrittling, grain boundary product during age-hardening.

2. The method of claim 1 wherein the Ni content at the grain boundary of individual dendrites is less than about 5 w/o Ni to inhibit formation of the embrittling grain boundary product.

3. The method of claim 1 wherein in step (a), the dendritic constituent comprises alpha phase.

4. The method of claim 1 wherein the Cu-Sn-Ni alloy comprises about 10.0 w/o Sn to about 12.0 w/o Sn, about 4.0 w/o to about 4.4 w/o Ni and the balance substantially Cu.

5. The method of claim 1 wherein the as-cast microstructure includes a relatively hard interdendritic constituent comprising primary gamma phase.

6. A method of making worm gearing comprising the steps of:

a) casting a Cu-Sn-Ni alloy melt comprising about 8 to about 13 weight % Sn and about 3.5 to about 5.0 weight % Ni and the balance essentially Cu at a cooling rate effective to provide an as-cast microstructure comprising a dendritic constituent characterized by Sn and Ni in supersaturated solid solution and by as-cast microsegregation of the Ni across individual dendrites such that the Ni content decreases from the dendrite interior to the grain boundary of the dendrite, and b) age-hardening the as-cast alloy from about 325 degrees C. to about 350 degrees C. for about 4.5 hours to about 8.5 hours to strengthen the dendritic constituent while substantially preventing formation of embrittling, grain boundary product during age-hardening.

7. A method of making worm gearing comprising the steps of:

a) casting a Cu-Sn-Ni alloy melt comprising about 8 to about 13 weight % Sn and about 3.5 to about 5.0 weight % Ni and the balance essentially Cu at a cooling rate effective to provide an as-cast microstructure comprising a dendritic constituent characterized by Sn and Ni in supersaturated solid solution and by as-cast microsegregation of the Ni across individual dendrites such that the Ni content decreases from the dendrite interior to the grain boundary of the dendrite, and b) age-hardening the as-cast alloy without an intermediate anneal followed by quenching or cooling so as to strengthen the as-cast dendritic constituent while substantially preventing formation of embrittling, grain boundary product during age-hardening.

* * * * *